US006085947A

United States Patent [19]

Lien

[11] Patent Number: 6,085,947

[45] Date of Patent: Jul. 11, 2000

[54] SOFT TYPE MOUTHPIECE WITH WATER RELEASING AND WATER STOPPING FUNCTIONS

[76] Inventor: Chien-Ping Lien, P.O. Box 82-144, Taipei, Taiwan

[21] Appl. No.: 09/224,889

[22] Filed: Dec. 31, 1998

[51] Int. Cl.[7] ..... B67D 3/00

[52] U.S. Cl. ..... 222/525; 222/522; 215/388

[58] Field of Search ..... 222/548, 549, 222/554, 555, 562, 563, 522, 525, 524; 220/705, 714, 718; 215/11.4, 388; 251/347, 353, 349; 128/202.15, 202.16, 206.29

[56] References Cited

U.S. PATENT DOCUMENTS

| | | | |
|---|---|---|---|
| 3,216,630 | 11/1965 | Stull . | |
| 3,738,545 | 6/1973 | Roy | 222/525 |
| 4,477,002 | 10/1984 | Stull | 222/521 |
| 4,708,260 | 11/1987 | Siegal et al. | 220/465 |
| 4,749,103 | 6/1988 | Barriac | 222/48 |
| 4,842,169 | 6/1989 | Stull | 222/521 |
| 5,060,833 | 10/1991 | Edison et al. | 224/148 |
| 5,104,008 | 4/1992 | Crisci | 222/153 |
| 5,456,374 | 10/1995 | Beck | 215/251 |
| 5,507,416 | 4/1996 | Rapchak et al. | 222/153.07 |
| 5,927,565 | 7/1999 | Paczonay | 222/484 |
| 5,988,448 | 11/1999 | Foth | 222/189.09 |

*Primary Examiner*—Lesley D. Morris
*Assistant Examiner*—Christopher S. Kim
*Attorney, Agent, or Firm*—A & J

[57] ABSTRACT

A soft type mouthpiece structure with water release and water stopping functions includes a soft type mouthpiece, a positioning seat, and a slidable sleeve. The mouthpiece has a front end provided with a water outlet and a rear end that can be insertably secured at a front end of the positioning seat. The positioning seat is provided with a hollow internal hole that includes a smaller-diameter internal channel and a larger-diameter sectioned portion. The inner wall of the sectioned portion is provided with a leakage-proof flange. A depressed groove is provided at the leakage-proof flange near the water outlet side. The slidable sleeve is provided with a projecting positioning flange on an outer wall of the front end of a tube portion thereof, an urging post at the center of the front end of the tube portion, the urging post being peripherally provided with a plurality of water slots. The slidable sleeve is inserted into the positioning seat with the urging tube stopping the internal channel of the positioning seat. By changing the relative position of the positioning seat and the slidable sleeve, release of water through the mouthpiece can be permitted or stopped.

3 Claims, 9 Drawing Sheets

SOFT TYPE MOUTHPIECE WITH WATER RELEASING AND WATER STOPPING FUNCTIONS

BACKGROUND OF THE INVENTION

1. Field of the Invention

The present invention relates to a soft type mouthpiece structure, and more particularly to a soft type mouthpiece structure with water releasing and water stopping functions, that is adapted for use on water bags or the like.

2. Description of the Prior Art

The mouthpiece or nipple structure on water bags used by cyclists or outdoor goers generally falls into two types: soft and hard types. Referring to FIGS. 1*a* and 1*b*, a soft type mouthpiece 1 is shaped like ordinary nipples of feeding bottles and is made of soft plastics like PU or silicon. The mouthpiece 1 includes a sucking head 2 having an I-shaped or cross-shaped slit 3 at a front end thereof. Due to the natural resetting squeezing of the periphery plate, water in the water bag cannot flow out through the slit 3 in a normal state, as shown in FIG. 1*a*. But when the soft sucking head 2 is pressed by the lips or bitten by teeth of the user, the slit 3 will open to release water in the water bag, as shown in FIG. 1*b*, and the user can therefore suck in the water.

Although it is easier to suck water from the water bag with a soft type mouthpiece, and the force applied by the user's mouth is extremely small, there are disadvantages. If a water bag with a soft type mouthpiece is carried in a handbag or backpack and is inadvertently squeezed by other articles in the bag or the user or other people happen to sit on the handbag or backpack, water in the water bag will flow out through the slit 3. If the handbag or backpack contains electronic articles such as electronic dictionaries, calculators, watches, these articles are likely to be damaged by the water leaked from the water bag. It is therefore necessary to enhance the practicality of soft type mouthpieces of water bags.

Referring to FIG. 2, a hard type mouthpiece 4 includes a stopper 5 and a spring 6 disposed therein, and a pressure element 7 that is protrudent on the outside. When the user bites the pressure element 7 so that the latter depresses to urge against the stopper 5 slantingly, water is stopped from flowing through the mouthpiece 4.

Although such a hard type mouthpiece can effectively control the release of water from the water bag, the force required to depress the pressure element 7 is great. Since the user has to exert a pressure on the pressure element 7 using his/her teeth while sucking in the water, such a structure requires greater skill in manipulation.

SUMMARY OF THE INVENTION

The present invention relates to a soft type mouthpiece structure, and more particularly to a soft type mouthpiece structure with water releasing and water stopping functions, that is adapted for use on water bags or the like.

A primary object of the present invention is to provide a water bag mouthpiece structure adapted for use by cyclists and outdoor goers, that has the advantages of easy suction and effective hand-controlled release and stopping of water, without the use of a hard mouthpiece that is not comfortable to the mouth.

Another object of the present invention is to provide a water mouthpiece structure that is detachable to allow easy cleaning so as to avoid breeding of germs and molds thereon if the water bag is used to contain beverages such as milk and juice.

DETAILED DESCRIPTION OF THE PREFERRED EMBODIMENT

Figure 1A:
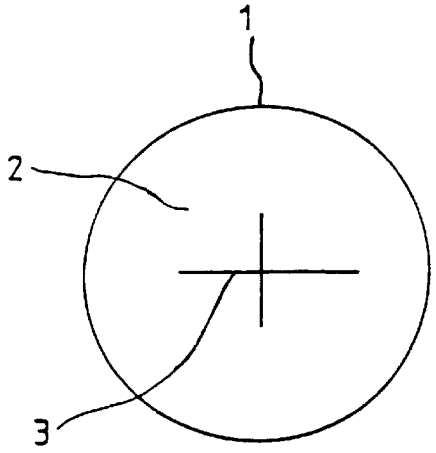
PRIOR ART FIG. 1A
FIGS. 1*a* and 1*b* are schematic views of the conventional soft type mouthpiece.
Figure 1B:
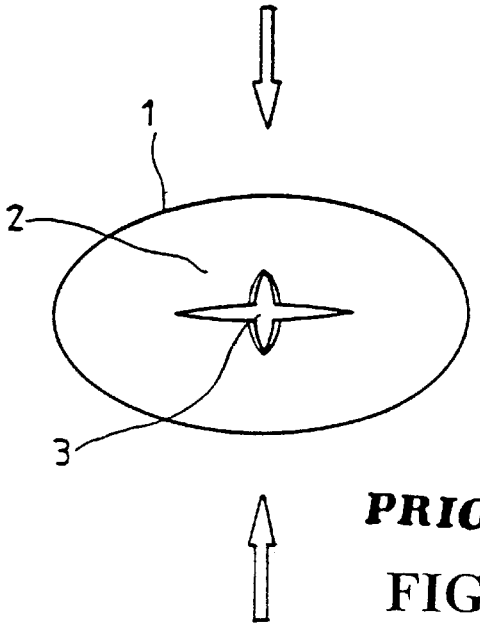
PRIOR ART FIG. 1B
Figure 2:
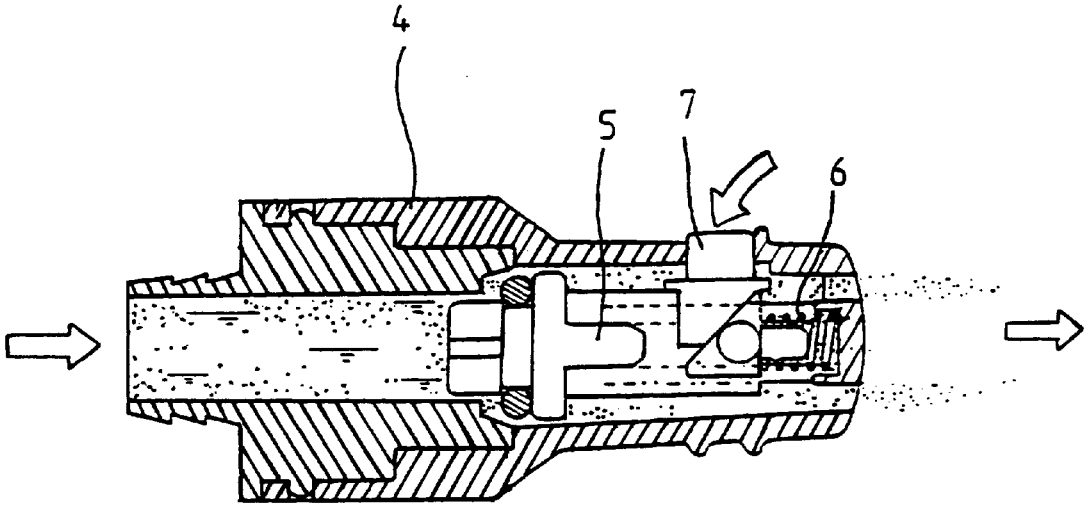
PRIOR ART FIG. 2
FIG. 2 is a schematic view of the conventional hard type mouthpiece.
Figure 3:
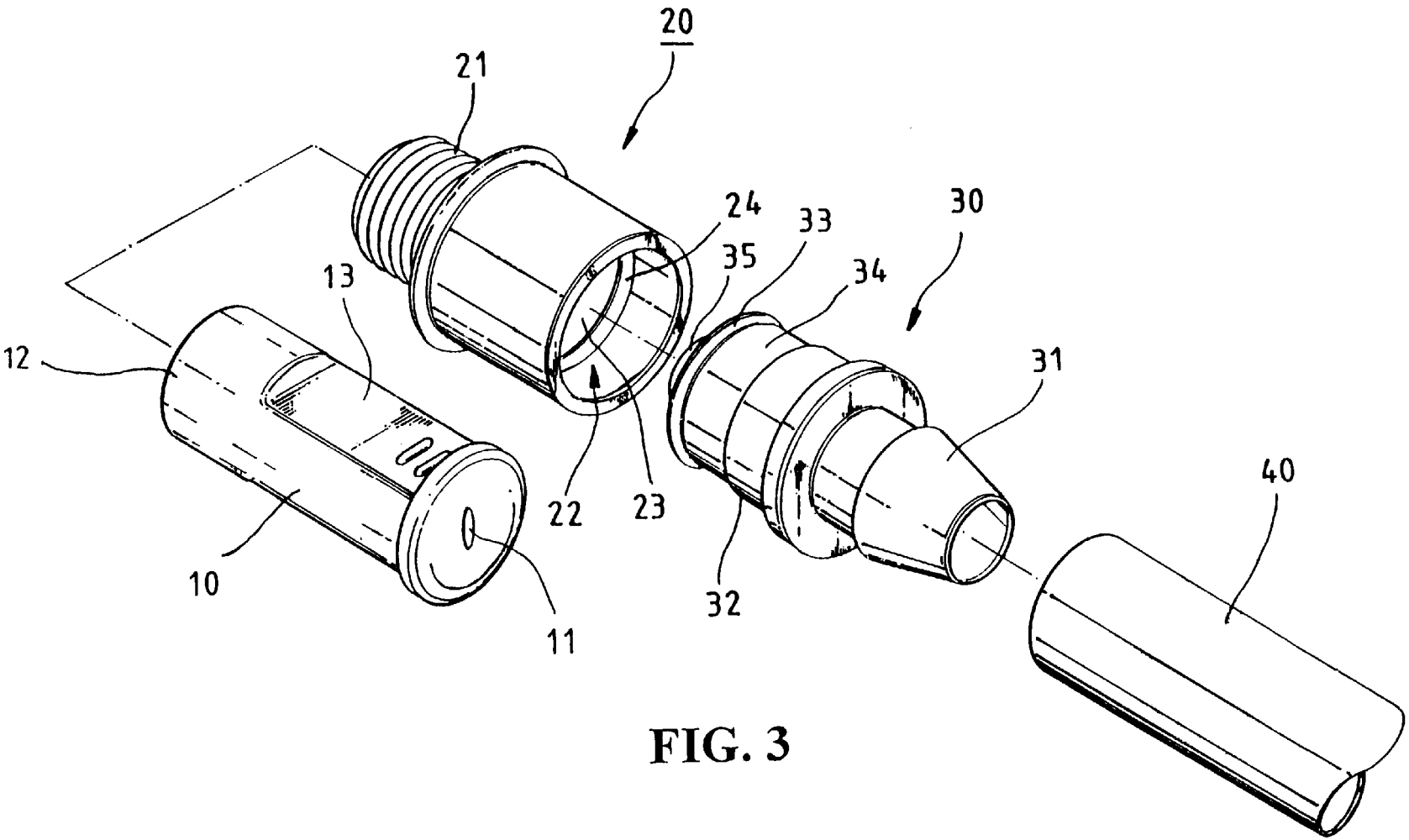
FIG. 3 is a perspective exploded view of the mouthpiece according to the present invention.
Figure 4:
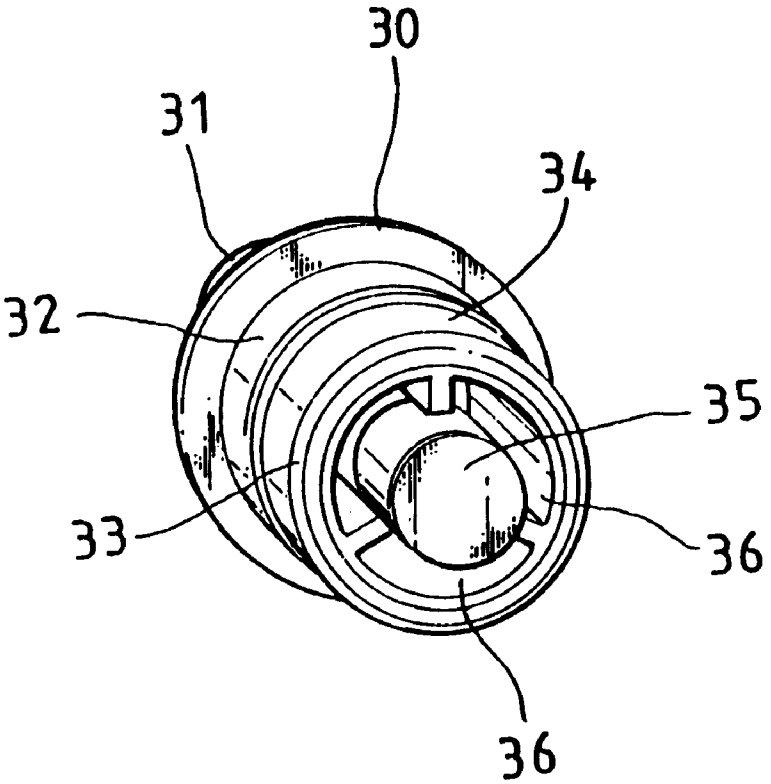
FIG. 4 is a perspective rear view of a slidable sleeve according to the present invention.

Referring to FIGS. 3 to 6, the mouthpiece structure according to the present invention is shown to comprise a soft type mouthpiece 10, a positioning seat 20, and a slidable sleeve 30. A rear end of the slidable sleeve 30 may be insertably connected to a water release guide tube 40 so as to connect to a water bag.

The soft type mouthpiece 10 is a nipple-like structure that is made of soft plastics. It has a front end provided with a water outlet 11 and a rear head having a large-diameter portion 12 that may be insertably secured on a toothed tube portion 21 of the positioning seat 20. A rear portion of the water outlet 11 is provided with a depression 13 adapted to be bitten by the user's teeth.

Figure 7:
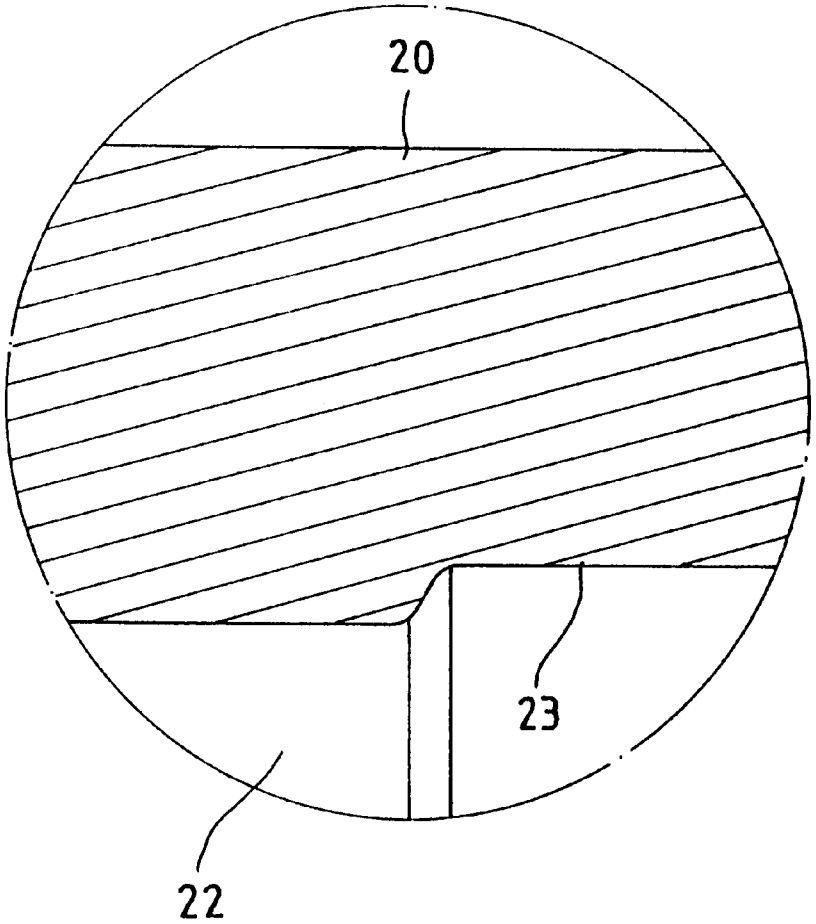
FIG. 7 is an enlarged schematic view of a positioning seat of the present invention in part.

The positioning seat 20 has the above-mentioned toothed tube portion 21 at one end and a hollow enlarged sectioned portion 22 at the other. The enlarged sectioned portion 22 has an inner wall provided with an annular depressed groove 23 (see FIG. 7) and a leakage-proof flange 24 respectively. The toothed tube portion 21 is provided with a gate 25 where it borders the sectioned portion 22.

The slidable sleeve 30 (see FIG. 40) is provided with a large ratchet tooth tube 31 at one end, and an annular tube 32 at the other. The annular tube 32 has an external diameter that can insert into the sectioned portion 22 of the positioning seat. The annular tube 32 further has an annular positioning flange 33 at a front end of its annular wall. A rear end of the positioning flange 33 is connected to a slide groove 34 that is indented suitably. Additionally, an urging post 35 is provided at the center of the front end of the annular tube 32 of the slidable sleeve 30. The periphery of the urging post 35 is hollowed out to form water ports 36. The external diameter of the urging post 35 is configured to urge against and stop the gate 25 of the positioning seat 20, whereas the positioning flange 33 has an external diameter sufficient to urge against the depressed groove 23 of the positioning seat 20.

Figure 5:
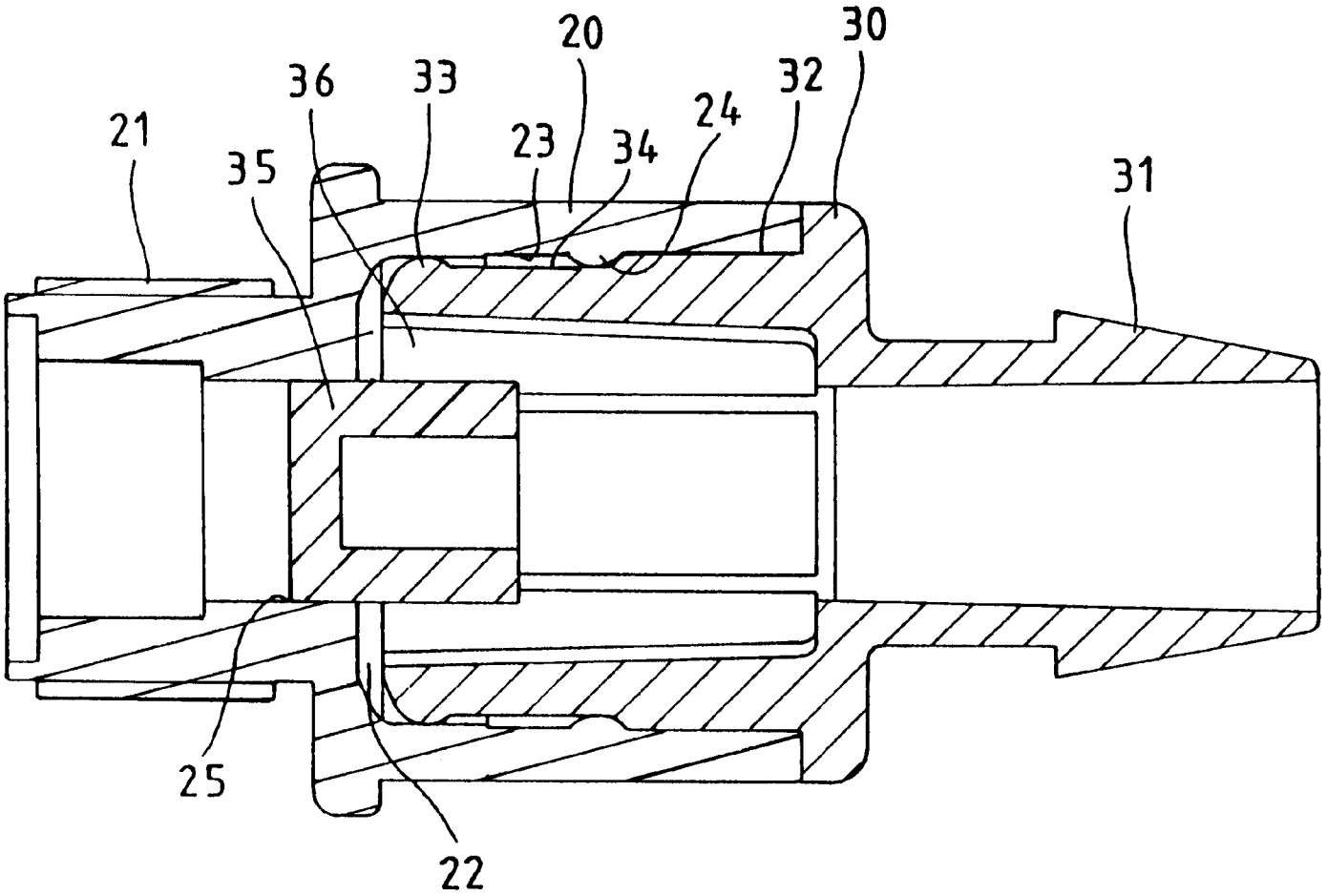
FIG. 5 is an assembled sectional view of FIG. 3, showing the mouthpiece of the present invention in a close state.

Referring to FIG. 5, when the slidable sleeve 30 is insertably coupled to the positioning seat 20, the urging post 35 of the slidable sleeve 30 will stop the gate 25 of the positioning seat 20 to prevent leakage of water. And the positioning flange 33 of the slidable sleeve 30 is also retained in the depressed groove 23, while the leakage-proof flange 24 of the positioning seat 20 is retained in the slide groove 34. Since the positioning seat 20 and the slidable sleeve 30 are both made of plastics, they have a certain non-metallic resilience. Hence, the above-mentioned retaining effects will achieve water-tightness.

Figure 6:
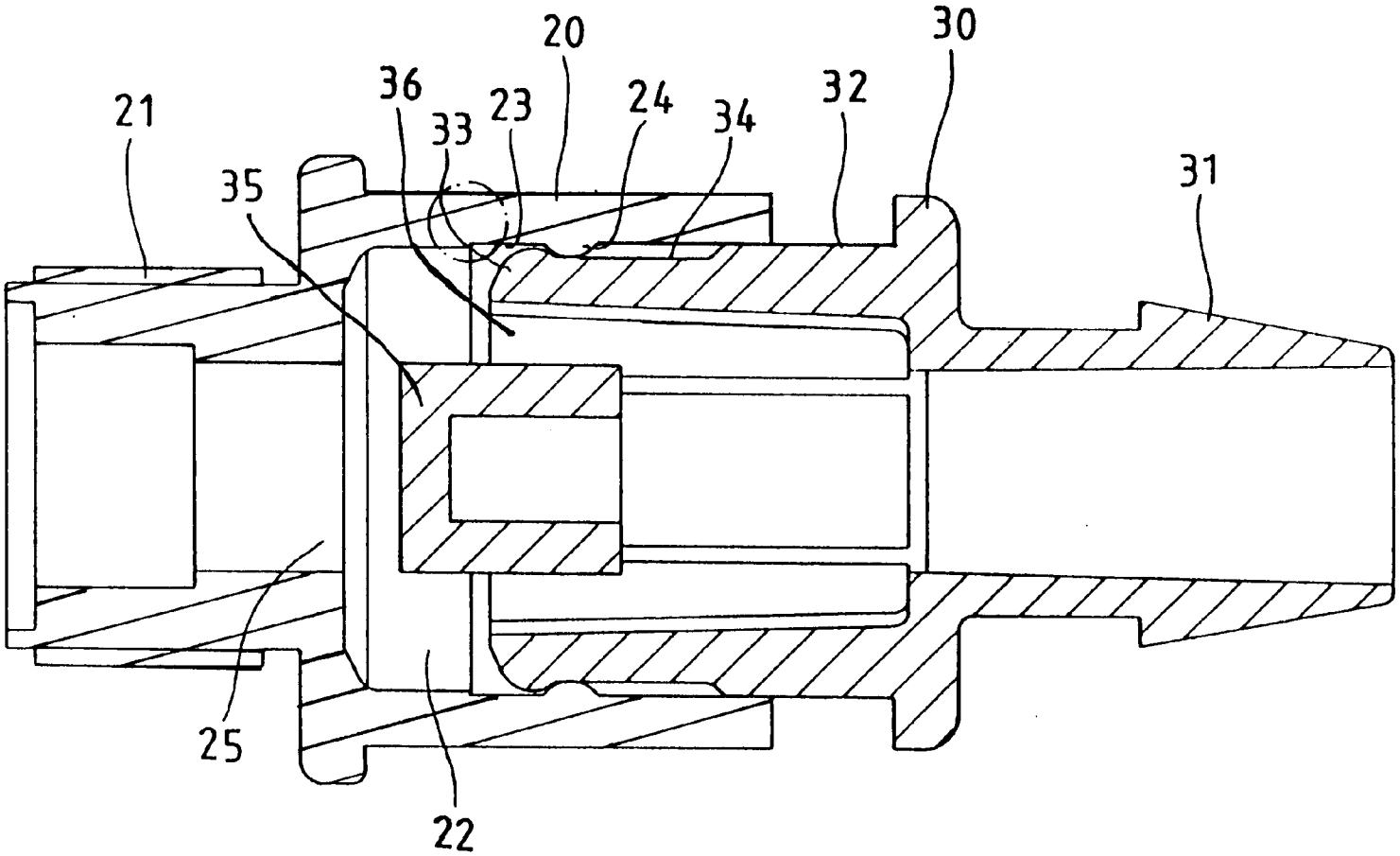
FIG. 6 is an assembled sectional view of FIG. 3, showing the mouthpiece of the present invention in an open state.

Referring to FIG. 6, when the positioning seat 20 and the slidable sleeve 30 are pushed apart from each other in reverse directions, the travel of sliding is limited by the leakage-proof flange 24 in the slide groove 34, and the positioning flange 33 is used to stop reversely, so that the urging post 35 can be timely control to move away from the gate 25, to allow drinking water from the water release guide tube to pass through the water ports 36 along the gate 25 into the soft type mouthpiece 10, so that the user can suck up the water with a comfortable feeling. Under normal conditions, the water outlets 36 are closed to stop flow of water from the mouthpiece 10.

Figure 8:
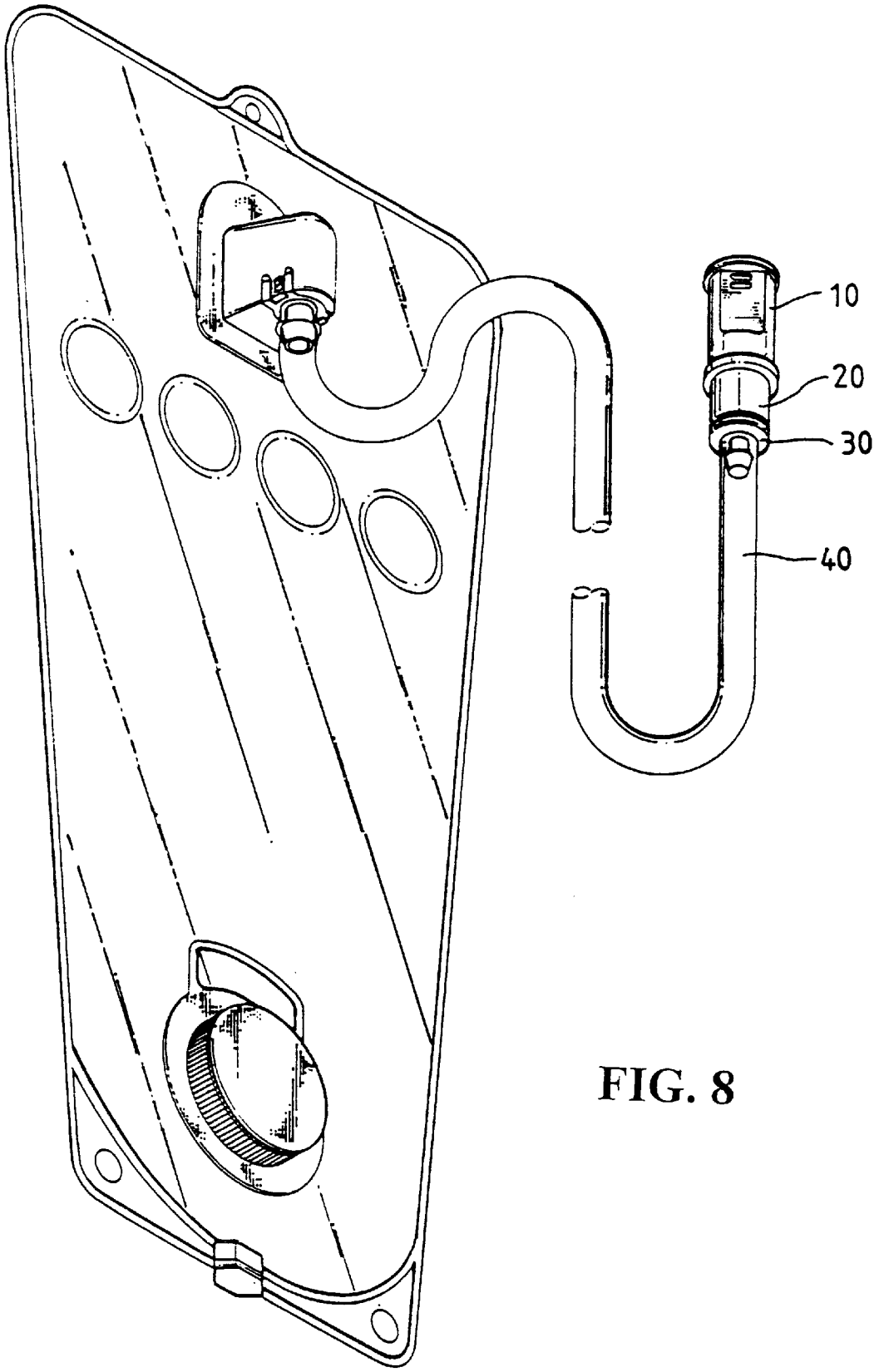
FIG. 8 is an example of the mouthpiece of the present invention adapted for use on a water bag.
Figure 9:
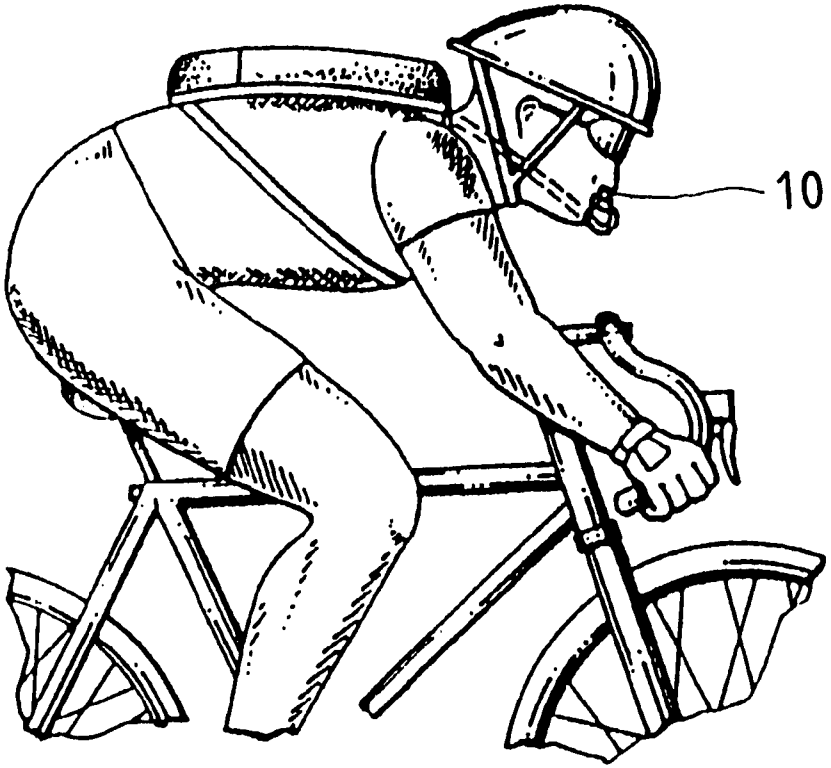
FIG. 9 is a schematic view illustrating use of the water bag according to the present invention by a cyclist.

Referring to FIG. 8, which illustrates the present invention in use, the water release guide tube 40 is connected to the interior of the water bag; the slidable sleeve 30 is insertably secured at the rear end of the guide tube 40; and the positioning seat 20 and the soft type mouthpiece 10 are individually assembled as a whole. With reference to FIG. 9, when a cyclist is cycling, he/she can hold the mouthpiece with one hand while biting the depression 13 to slightly pull the slidable sleeve 40 away from the positioning seat 40 in a reverse direction so that the urging post 35 in the mouthpiece displaces away from the gate 25 to allow passage of water.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A soft type mouthpiece structure with water release and water stopping functions, comprising:

a soft type mouthpiece having a water outlet at a front end, and a rear end;

a positioning seat having a toothed tube portion internally provided with an internal channel of a smaller diameter at one end, and a sectioned portion of a larger diameter, said sectioned portion having an inner wall provided with a leakage-proof flange and a depressed groove, said rear end of said mouthpiece being insertably secured on said toothed tube of said positioning seat; and a slidable sleeve having a ratchet tooth tube at one end, and an annular tube at the other end that can insert into said sectioned portion of said positioning seat, said annular tube having an annular wall provided with a positioning flange, a suitably indented slide groove at a rear end of said positioning flange, and an urging post at the center of a front end of said annular tube, the periphery of said urging post being hollowed out to form water slots;

whereby said slidable sleeve is inserted into said sectioned portion of said positioning seat such that said urging post closes a gate, with said leakage-proof flange of said positioning seat retained in said slide groove of said slidable sleeve, said positioning flange of said slidable sleeve being retained in said depressed groove of said positioning seat as well, thereby changing the relative position of said positioning seat and said slidable sleeve to achieve water release or water stopping.

2. The soft type mouthpiece structure with water release and water stopping functions as claimed in claim 1, wherein said ratchet tooth tube of said slidable sleeve may be insertably connected to a water outlet guide tube of a water bag.

3. The soft type mouthpiece structure with water release and water stopping functions as claimed in claim 1, wherein said soft type mouthpiece is provided with a depression at a rear end of said water outlet, said depression being adapted to be bitten by a user's teeth.

* * * * *